US010131106B2

(12) United States Patent
Grus

(10) Patent No.: US 10,131,106 B2
(45) Date of Patent: Nov. 20, 2018

(54) PACKAGING MACHINE FORMER

(71) Applicant: TNA Australia Pty Limited, Homebush Bay (AU)

(72) Inventor: Marek Grus, Homebush Bay (AU)

(73) Assignee: TNA Australia Pty Limited, Lidcombe, New South Wales (AU)

( * ) Notice: Subject to any disclaimer, the term of this patent is extended or adjusted under 35 U.S.C. 154(b) by 923 days.

(21) Appl. No.: 14/137,843

(22) Filed: Dec. 20, 2013

(65) Prior Publication Data

US 2014/0179502 A1 Jun. 26, 2014

(30) Foreign Application Priority Data

Dec. 21, 2012 (AU) ..... 2012905629

(51) Int. Cl.

| | |
|---|---|
| ***B31B 70/00*** | (2017.01) |
| ***B31B 49/04*** | (2006.01) |
| *B31B 160/10* | (2017.01) |
| *B31B 70/36* | (2017.01) |
| *B31B 70/26* | (2017.01) |
| *B31B 155/00* | (2017.01) |

(52) U.S. Cl.

CPC ..... *B31B 49/04* (2013.01); *B31B 70/00* (2017.08); *B31B 70/261* (2017.08); *B31B 70/36* (2017.08); *B31B 2155/001* (2017.08); *B31B 2160/10* (2017.08)

(58) Field of Classification Search

USPC ..... 53/563, 574; 493/250, 302

See application file for complete search history.

(56) References Cited

U.S. PATENT DOCUMENTS 2,628,464 A * 2/1953 Plata ..... B65B 9/06 156/383
3,296,770 A * 1/1967 Wilson ..... B65B 9/2035 493/248
3,415,171 A * 12/1968 Wilson ..... B65B 9/22 493/302

(Continued)

FOREIGN PATENT DOCUMENTS

DE 1262870 B * 3/1968 ..... B65B 9/06
DE 1586334 B * 3/1972 ..... B65B 9/06

(Continued)

OTHER PUBLICATIONS

Search Report dated Jan. 24, 2014, from British Application No. GB1322024.9 (4 pages).

(Continued)

*Primary Examiner* — Hemant M Desai
*Assistant Examiner* — Tanzim Imam
(74) *Attorney, Agent, or Firm* — Kilpatrick Townsend & Stockton LLP

(57) ABSTRACT

A former shoulder (10) for a packing machine. The former shoulder (10) includes a former (12) having an external surface (13) over which strip bag material passes to be reconfigured into a tubular configuration. The bag material passes downwardly through a central opening (14) in the former shoulder (10). The former shoulder (10) includes a pair of pivoted guides (22, 23) that engage edge portions of the tubular bag material to form a fold (29) in the bag configuration (26) of the tubular bag material.

12 Claims, 2 Drawing Sheets

(56) References Cited

U.S. PATENT DOCUMENTS 3,482,491 A * 12/1969 Gustafson ..... B29C 53/52 156/203
3,486,424 A * 12/1969 Tanner ..... B65B 9/22 493/302
3,962,958 A * 6/1976 Hobart ..... B65B 9/22 156/466
4,079,662 A 3/1978 Puccetti et al.
4,084,999 A * 4/1978 Rucker ..... B29C 53/52 138/151
4,532,754 A * 8/1985 Hokanson ..... B65B 9/213 383/200
4,663,917 A 5/1987 Taylor et al.
4,753,336 A 6/1988 Taylor et al.
5,255,495 A 10/1993 Kovacs
5,622,032 A 4/1997 Ryan
5,707,329 A * 1/1998 Pool ..... B65B 9/22 493/302
5,845,465 A * 12/1998 Bennett ..... B29C 66/8169 53/374.3
6,098,380 A * 8/2000 Goodwin ..... B65B 9/2021 53/451
6,155,030 A * 12/2000 Inoue ..... B29C 65/7847 53/374.2
6,428,457 B1 * 8/2002 Fukuda ..... B65B 9/20 493/302
7,124,559 B2 10/2006 Taylor
7,152,387 B2 12/2006 Taylor
7,159,376 B2 1/2007 Taylor
7,383,672 B2 6/2008 Taylor et al.
7,415,809 B2 8/2008 Taylor
2002/0062629 A1 5/2002 Taylor
2005/0016131 A1 1/2005 Laplace
2005/0172582 A1 * 8/2005 Taylor ..... B65B 31/045 53/511
2010/0199614 A1 8/2010 Taylor et al.
2012/0233970 A1 9/2012 Taylor
2013/0165305 A1 6/2013 Taylor
2013/0165306 A1 6/2013 Grus

FOREIGN PATENT DOCUMENTS

EP 0 275 181 A2 7/1988
EP 1 652 771 A1 5/2006
GB 988273 A * 4/1965 ..... B31B 1/42
GB 1 203 684 9/1970

OTHER PUBLICATIONS

English translation of Notice of Reasons for Rejection dated Jul. 25, 2017 in related Japanese Patent Application No. JP 2013-263549 (four pages).
British examination report, dated Dec. 20, 2017, of the corresponding British patent application No. GB1322024.9.(two pages).

* cited by examiner

PACKAGING MACHINE FORMER

CROSS REFERENCES TO RELATED APPLICATIONS

This application claims priority to Australian Application No. 2012905629, filed Dec. 21, 2012, the disclosure of which is incorporated by reference herein.

FIELD

The present invention relates to former shoulders employed to provide bag material in tubular form for a packaging machine.

BACKGROUND

In forming packages, such as packages of snack foods, bag material in strip form is delivered to a former shoulder. The former shoulder reconfigures the strip material into a tubular configuration. The tubular bag material is longitudinally sealed along its overlapping longitudinal edges and delivered to a packaging machine. Product is delivered to the interior of the former shoulder so as to be located internally of the tubular bag material, with the packaging machine then transversely sealing and cutting the bag material to form bags of product.

Examples of the above discussed packaging machines and former shoulders are described in European Patent 0275181, U.S. Pat. Nos. 5,622,032, 4,663,917, 7,159,376, 7,383,672, 4,753,336, 7,124,559, 7,415,809, 7,152,387, and U.S. patent application Ser. Nos. 09/946,153, 12/665,023, 13/421,596, 13/705,038 and 13/692,937.

A disadvantage of the above described former shoulders is that a large number of the former shoulders is required to accommodate bags of different sizes and bags of different configurations. For example a former shoulder is configured to suit a particular bag size. In addition, there is the configuration of the longitudinal edges of the tubular bag material that is configured to meet various bag needs. Different bags have different configurations which in turn require different formers.

A particular disadvantage of the above shoulders is that the manufacturer (supplier) of the shoulders needs to manufacture a wide variety of the shoulders in order to meet the varying needs of their clients. A still further disadvantage is that should a former that has been delivered required modification, then the modification can be attended to without replacing the former shoulder.

OBJECT

It is the object of the present invention to overcome or substantially ameliorate at least one of the above disadvantages.

SUMMARY

There is disclosed herein a former shoulder for a packaging machine, the shoulder being configured to engage strip bag material including:

a former member having a former surface surrounding a central aperture, the surface being provided to receive the strip bag material to form the strip bag material into a tubular configuration for delivery in a delivery direction to the interior of the former via said central opening; and a bag material guide located internally of the former and adjacent the opening, the guide being operable to engage longitudinal edge portions of the bag material to provide the bag material with a predetermined configuration, with the guide being alterable in position to change said configuration.

Preferably, the opening has an upper portion and a lower portion with the guide being located adjacent the lower portion.

Preferably, the guide is a pair of guides that are moved relative to each other to change said configuration.

Preferably, the guide is an assembly including a pair of arms that are pivotally movable about axes generally perpendicular relative to said delivery direction.

Preferably, the arms are upwardly oriented.

Preferably, each of the arms has an upper end and a lower end, with the arms being pivotally supported at their upper ends.

Preferably, said direction is downward, and the arms pivot about spaced, generally parallel horizontal axes.

Preferably, the arms are angularly movable between positions at which arms are spaced, and positions at which they overlap.

Preferably, said former shoulder includes a base supporting the former, and a mounting bracket fixed to the base, and wherein the arms are pivotally mounted on the bracket.

Preferably, the bracket is at least partly located internally of the former.

BRIEF DESCRIPTION OF DRAWINGS

Preferred forms of the present invention will now be described by way of example with reference to the accompanying drawings wherein.

DESCRIPTION OF EMBODIMENTS

Figure 1:
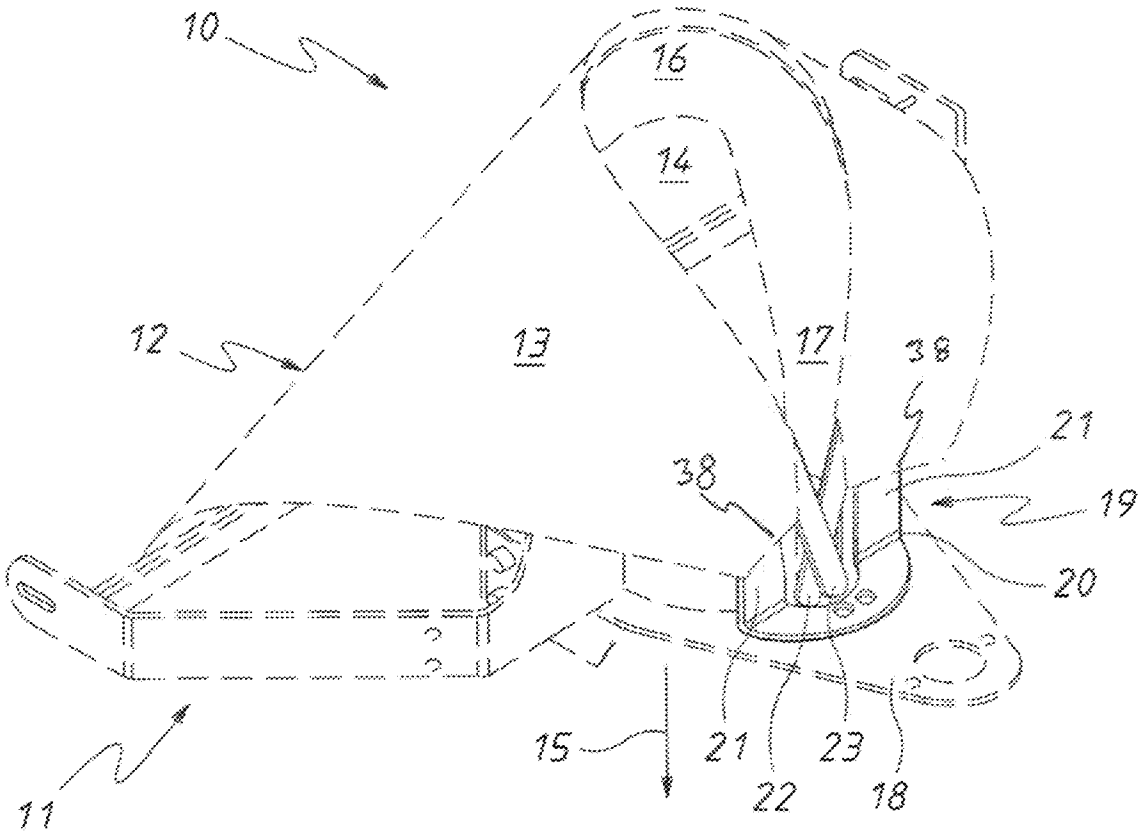
FIG. 1 is a schematic isometric view of a former shoulder.

In FIGS. 1 to 4 there is schematically depicted a former shoulder 10. The shoulder 10 includes a base (frame) 11 that supports a former 12. The former 12 has an external surface 13 that surrounds a central former opening 14. Strip bag material is received by the surface 13 that transforms the strip bag material into a tubular form for delivery to the central opening 14. The tubular bag material then passing in the downward delivery direction 15 to a packaging machine below. Product is delivered from above into the opening 14, so that batches of product are located internally of the tubular bag material. The tubular bag material with batches of product located therein is delivered to the packaging machine below, with the packaging machine transversely sealing and transversely cutting the tubular bag material to form discrete bags of product. Prior to the tubular bag material reaching the packaging machine, there is placed between the former shoulder 10 and the packaging machine a heated bar that sealingly connects the overlapping longitudinal edges of the strip bag material.

The opening 14 includes an upper portion 16 that has an arcuate periphery, with the upper portions 16 tapering downwardly to a lower portion 17. As the tubular bag material passes through the opening 16, the overlapping edges of the tubular bag material passes through the lower portion 17. The surface 13, as seen in FIG. 1, has a lower most extremity 38 adjacent the opening lower portion 17.

The frame 11 includes a plate 18 that extends generally normal to the direction 15 from a position beneath the surface 13 to a position spaced laterally outward of the surface 13.

Figure 3:
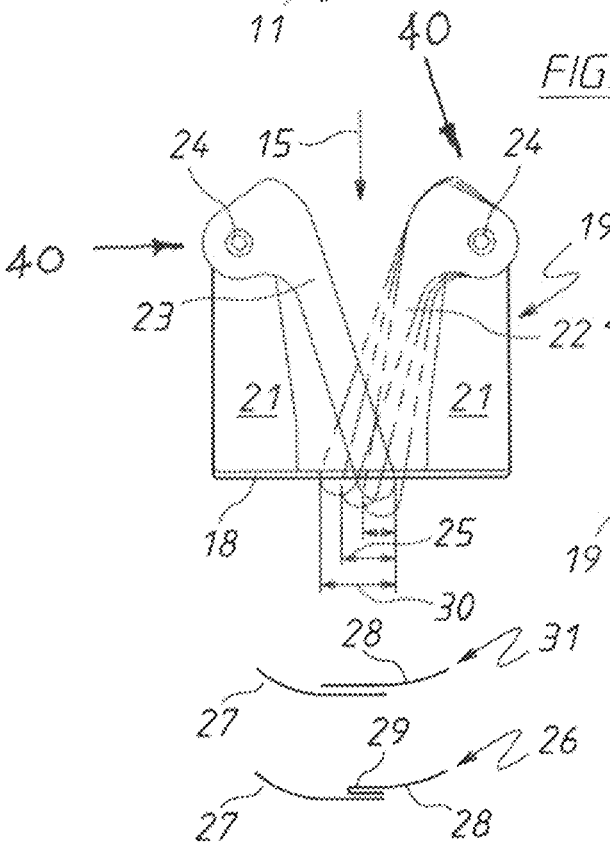
FIG. 3 is a schematic front elevation of guides employed in the former shoulder of FIGS. 1 and 2 with bag configurations reduced by the guides.
Figure 4:
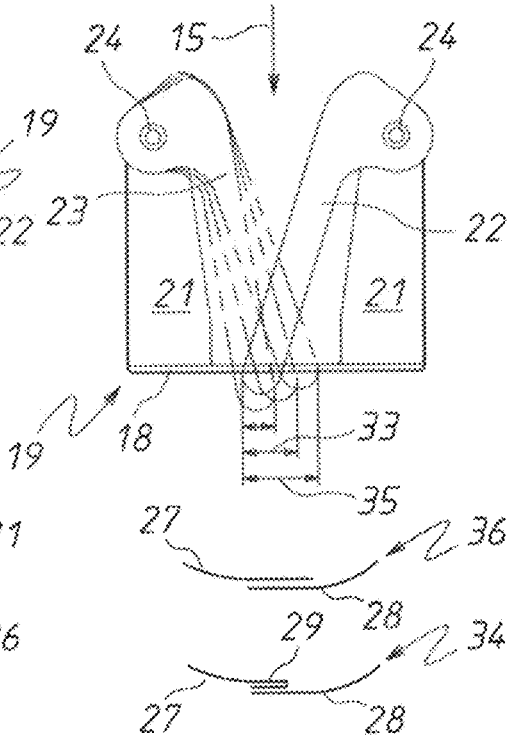
FIG. 4 is a schematic front elevation of the guides of FIG. 3 in alternative positions with the bag configurations produced thereby.

Mounted on the plate 18 is a guide 19 that engages the longitudinal edge portions of the tubular bag material so as to guide the edge portions into a desired configuration for the particular bag to be manufactured. In FIGS. 3 and 4 desired configurations of the edge portions of the bag material are illustrated.

The guide 19 includes a mounting bracket 20 that includes a pair of upwardly extending flanges 21 that project upwardly behind the surface 13 so as to be located generally internally of the former 12. The guide 19 has an upper part 40 located internally of the former 12 so as to be above the lower most extremity 38.

The guide 19 is an assembly including a pair of guides 22 and 23. Preferably the guides 22 and 23 are a pair of generally vertically oriented arms. More preferably the guides 22 and 23 are pivotally attached at their upper ends to the upper ends of the flanges 21 at the upper part 40 of the guide 19. The guides 22 and 23 would pivot about spaced axes 37 that are generally perpendicular to the direction 15, with the guides 22 and 23 extending downward from the axes 37. Accordingly the axes 37 are generally horizontal and parallel. The guides 22 and 23 would be secured to the flanges 21 by means of pivot pins 24 that would engage the guides 22 and 23 and urge them against the flanges 21 to frictionally retain the guides 22 and 23 in a desired position. More preferably the guides 22 and 23 and flanges 21 have cooperating projections and recesses that engage to retain the guides 22 and 23 in a desired position. The projections and/or recesses would be angularly arranged about the axes 37. Typically a fastener would be employed that is tension to ensure that the guides 22 and 23 are retained in the selected angular position by engagement of the projections and recesses. An operator would merely grip the guides 22 and 23 and pivot them to the next desired position. They would then be retained in this position by frictional engagement with the flanges 21, or the engagement of the projections and recesses.

Figure 2:
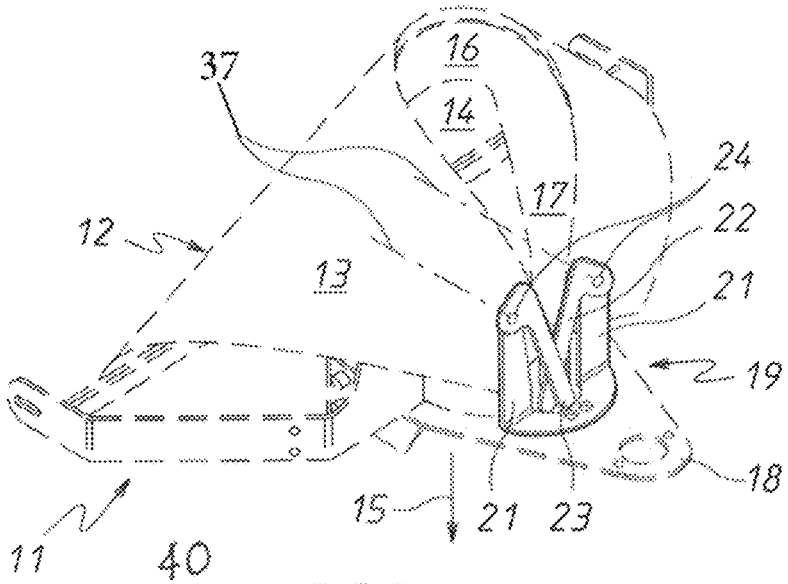
FIG. 2 is a schematic isometric view of the former shoulder of FIG. 1.

The guides 22 and 23 are movable angularly about the axes 24. More particularly they can be moved angularly from a position at which they are spaced from each other (not overlapping). However they may be moved angularly to overlapping positions with the guide 23 in front of the guide 22 (as shown in FIG. 2 and FIG. 3) and a position at which the guide 22 is in front of the guide 23 as shown in FIG. 4.

With particular reference to FIG. 3, an overlap of the guides 22 and 23 by the amount 25 would result in the bag configuration 26, that is with the longitudinal edges portions 27 and 28 configured, with the edge portion 28 behind the edge portion 27, and the edge portion 28 with a fold 29. When the guides 22 and 23 overlap by the amount 30, the overlap configuration 31 is produced, that is with the edge portion 27 in front of the edge portion 28.

With reference to FIG. 4, when the guides 22 and 23 overlap by the amount 33, the overlap configuration 34 is produced. The edge portion 28 is in front of the edge portion 27, with the edge portion 27 having the fold 29. When the guides 22 and 23 overlap by the amount 35, the overlap configuration 36 is produced, that is with the edge portion 28 in front of the edge portion 27 with no fold.

The above described preferred embodiments have the advantage that by use of the guides 22 and 23, the former 10 can accommodate forming bags of different sizes and different configurations without having to remove and replace the former shoulder 10. Still further, the former shoulder 10 takes the place of a series of former shoulders that would be required to provide the bags of different sizes and configurations.

The invention claimed is:

1. A former shoulder for a packaging machine, the former shoulder being configured to engage a strip of bag material, the former shoulder comprising:

a former member having a former surface surrounding a central aperture, wherein the central aperture comprises an aperture upper portion and an aperture lower portion, wherein the former surface is configured to receive the strip of bag material to form the strip of bag material into a tubular bag material, having a tubular configuration, for delivery in a delivery direction to the interior of the former member via said central aperture, and wherein the former surface comprises a lower extremity adjacent to the aperture lower portion; and a bag material guide having an upper part above said lower extremity and located internally of the former member and adjacent to the central aperture, the guide being operable to engage longitudinal edge portions of the tubular bag material, wherein a position of the guide is alterable to change said tubular configuration to a predetermined configuration;

wherein the guide includes a pair of arms configured to engage the longitudinal edge portions, wherein the pair of arms are pivotable about axes extending perpendicular relative to said delivery direction, wherein each arm comprises an upper end via which the arms are pivotably mounted about said axes and a lower end opposite the upper end so that the arms extend downwardly from said axes, wherein the upper ends of the arms are spaced horizontally inward of the former shoulder from the former surface so that the axis corresponding to each arm passes through the former surface before and after passing through the corresponding arm, and where the arms are configured to pivot so that the lower ends move relative to each other in order to provide said predetermined configuration.

2. The former shoulder of claim 1, wherein the arms extend downwardly from adjacent to the aperture lower portion.

3. The former shoulder of claim 2, wherein the arms are configurable to be vertically oriented.

4. The former shoulder of claim 1, wherein the arms are pivotally supported at their upper ends adjacent to said aperture lower portion so that the arms extend downward from adjacent to the aperture lower portion.

5. The former shoulder of claim 4, wherein said delivery direction is downward, and said axes are horizontal.

6. The former shoulder of claim 1, wherein the arms are angularly pivotable between positions at which the arms do not overlap, and positions at which the arms overlap.

7. The former shoulder of claim 1, further including a base supporting the former member, and a mounting bracket fixed to the base, wherein the arms are pivotally mounted on the mounting bracket.

8. The former shoulder of claim 7, wherein the mounting bracket is at least partly located internally of the former member.

9. The former shoulder of claim 2, wherein the arms are angularly angularly pivotable between positions at which the arms do not overlap, and positions at which the arms overlap.

10. The former shoulder of claim 4, further including a base supporting the former member, and a mounting bracket fixed to the base, wherein the arms are pivotally mounted on the mounting bracket.

11. The former shoulder of claim 10, wherein the mounting bracket is at least partly located internally of the former member.

12. The former shoulder of claim 1, wherein the guide is configured to provide a fold in one of the longitudinal edge portions.

* * * * *